US008602409B2

(12) United States Patent
Sekiguchi

(10) Patent No.: US 8,602,409 B2
(45) Date of Patent: Dec. 10, 2013

(54) SHEET FEEDING APPARATUS AND IMAGE FORMING APPARATUS

(75) Inventor: Hajime Sekiguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/069,823

(22) Filed: Mar. 23, 2011

(65) Prior Publication Data

US 2011/0241285 A1 Oct. 6, 2011

(30) Foreign Application Priority Data

Apr. 2, 2010 (JP) ..... 2010-086464

(51) Int. Cl.
*B65H 1/08* (2006.01)

(52) U.S. Cl.
USPC ..... 271/147; 271/162

(58) Field of Classification Search
USPC ..... 271/162, 147, 130, 30.1, 22, 24, 128, 271/152, 155, 156, 157, 127, 126, 117, 118
See application file for complete search history.

(56) References Cited

U.S. PATENT DOCUMENTS

| | | | | |
|---|---|---|---|---|
| 5,829,898 | A * | 11/1998 | Hill et al. | 400/624 |
| 6,545,255 | B2 | 4/2003 | Sato et al. | |
| 6,741,815 | B1 | 5/2004 | Fujita et al. | |
| 6,954,608 | B2 | 10/2005 | Sekiguchi et al. | |
| 6,961,991 | B2 | 11/2005 | Fuseya et al. | |
| 6,963,718 | B2 | 11/2005 | Sekiguchi | |
| 7,009,158 | B2 | 3/2006 | Sekiguchi et al. | |
| 7,027,764 | B2 | 4/2006 | Sekiguchi et al. | |
| 7,069,640 | B2 | 7/2006 | Fuseya et al. | |
| 7,081,604 | B2 | 7/2006 | Sekiguchi | |
| 7,641,188 | B2 | 1/2010 | Hiura et al. | |
| 7,900,909 | B2 | 3/2011 | Hiura et al. | |

FOREIGN PATENT DOCUMENTS

| | | | |
|---|---|---|---|
| JP | 56-70240 | * | 6/1981 |
| JP | 8-127434 | | 5/1996 |
| JP | 2000-327141 | * | 11/2000 |
| JP | 2002-347985 | * | 12/2002 |

OTHER PUBLICATIONS

Machine translation of JP 8-127434.*

* cited by examiner

*Primary Examiner* — Thomas Morrison
(74) *Attorney, Agent, or Firm* — Fitzpatrick, Cella, Harper & Scinto

(57) ABSTRACT

A sheet feeding apparatus has a sheet accommodating portion, a sheet stacking portion, a lift mechanism, a driving portion provided, and a damper portion. The lift mechanism can be engaged with and disengaged from the driving portion, and if the engagement between the lift mechanism and the driving portion is released, the lift mechanism lowers the sheet stacking portion, the damper portion is engaged with the lift mechanism, and if the engagement between the lift mechanism and the driving portion is released, the damper portion exerts damper effect on the lift mechanism to reduce a lowering speed of the sheet stacking portion, and wherein the damper portion does not exert the damper effect on the lift mechanism until the sheet stacking portion is lowered by a predetermined amount after the engagement between the lift mechanism and the driving portion is released.

6 Claims, 9 Drawing Sheets

SHEET FEEDING APPARATUS AND IMAGE FORMING APPARATUS

This application claims the benefit of Japanese Patent Application No. 2010-086464, filed Apr. 2, 2010, which is hereby incorporated by reference herein in its entirety.

BACKGROUND OF THE INVENTION

1. Field of the Invention present invention relates to a sheet feeding apparatus and an image forming apparatus, and more particularly, to control of a lowering speed when a sheet stacking plate on which sheets are stacked is lowered.

2. Description of the Related Art

A conventional image forming apparatus such as a printer, a facsimile machine or a copying machine is provided with a sheet feeding apparatus which separates an uppermost one of a plurality of sheets accommodated in a sheet cassette and feeds the separated sheet. The sheet feeding apparatus has a sheet cassette and a sheet stacking plate provided in the sheet cassette such that the sheet stacking plate can be lifted and lowered, and sheets are stacked and supported on the sheet stacking plate. When a sheet is fed and an upper surface of the sheet is lowered, the sheet stacking plate is lifted so that the height of the uppermost sheet is maintained in such a range that the sheet can be fed.

In the image forming apparatus having such a conventional sheet feeding apparatus, when sheets are added or a sheet jam is handled, the sheet cassette is pulled out from an apparatus body. When the sheet cassette is pulled out, support of a lift mechanism is released and the sheet stacking plate is lowered (drops) by its own weight, but noise (impulsive sound) is generated in some cases due to impact that results when the lift mechanism is lowered. Especially when a large amount of sheets is stacked on the sheet stacking plate, a loud impulsive sound is generated.

Hence, as countermeasures against noise which is generated when the sheet stacking plate is lowered, it is proposed to slow down a lowering speed of the sheet stacking plate using a damper (see Japanese Patent Laid-Open No. 8-127434). By slowing the lowering speed of the sheet stacking plate in this manner, it is possible to moderate the impact received by the sheet stacking plate and to reduce the noise.

FIG. 8 illustrates a configuration of a sheet cassette having a conventional damper mechanism. The sheet cassette 34 has a relatively large sheet stacking capacity and large-size sheets can be accommodated therein. A sheet stacking plate 35 is provided in the sheet cassette 34 such that the sheet stacking plate 35 can turn in the vertical direction around a fulcrum 35*a*. A lifter plate 55 receives a driving force from an image forming apparatus body (not illustrated) and is rotated, and the sheet stacking plate 35 lifts the sheets, by the lifter plate 55, to a position where uppermost one of stacked sheets can be fed.

A chipped-tooth gear 42 is provided on a side surface of the sheet stacking plate 35, and a damper gear 51 is provided on an inner wall surface of the sheet cassette 34. The chipped-tooth gear 42 includes a gear portion 42*a* which meshes with the damper gear 51, and a chipped-tooth portion 42*b* which is located below the gear portion 42*a* and which cannot mesh with the damper gear 51.

FIG. 8 illustrates a state where a large amount of sheets P is stacked and in this state, the damper gear 51 and the gear portion 42*a* of the chipped-tooth gear 42 mesh with each other. If the sheet cassette 34 is pulled out from the image forming apparatus body in this state, the engagement between a driving force on the side of the body and the lifter plate 55 is released. At that time, the sheet stacking plate 35 is lowered by its own weight, but since the sheet stacking plate 35 is located at a position where the damper gear 51 meshes with the gear portion 42*a* of the chipped-tooth gear 42, the sheet stacking plate 35 is damped by the damper gear 51 and is lowered gently.

However, when the amount of stacked sheets P is small, the sheet stacking plate 35 turns upward and with this, the chipped-tooth gear 42 is also lifted and the damper gear 51 comes to a position facing the chipped-tooth portion 42*b* of the chipped-tooth gear 42. That is, the damper gear 51 and the chipped-tooth gear 42 are not connected to each other. Therefore, if the sheet cassette 34 is pulled out when the number of stacked sheets is small, the lowering speed of the sheet stacking plate 35 immediately after the sheet cassette 34 is pulled out becomes fast. Thereafter, if the gear portion 42*a* of the chipped-tooth gear 42 and the damper gear 51 mesh with each other during the lowering motion of the sheet stacking plate 35, the lowering speed of the sheet stacking plate 35 becomes slow by the damper gear 51.

The conventional sheet feeding apparatus and image forming apparatus include a sheet presence/absence sensor which detects the presence or absence of sheets on the sheet stacking plate by inserting a sensor arm into an opening formed in the sheet stacking plate. If the sheet presence/absence sensor detects that sheets have run out, a user pulls out the sheet cassette from the image forming apparatus body to supply sheets.

At that time, if the sensor arm is inserted into the opening of the sheet stacking plate, there is an adverse possibility that the sheet stacking plate and the sensor arm interfere with each other when the sheet cassette is pulled out. Therefore, according to the conventional apparatus, when the sheet cassette is pulled out, the lowering speed of the sheet stacking plate is set to be fast immediately after the sheet cassette is pulled out, but the lowering speed of the sheet stacking plate can be fast only when the number of sheets stacked on the sheet stacking plate is small, and when a large number of sheets are stacked, the above-described problem cannot be solved.

Further, when a sheet jam occurs, the sheet cassette 34 is pulled out from the image forming apparatus body, but when the sheet cassette 34 is pulled out, the sensor arm is in contact with the uppermost sheet on the sheet stacking plate. When the sheet jam occurs, not only the sensor arm but also a feeding roller located above the sheet stacking plate are in contact with uppermost one of the sheets.

In such as case, if the sheet cassette is pulled out, and the sensor arm and the feeding roller rub against the uppermost sheet, there is the possibility of the roller surface being scarred or the sheet being damaged by the uppermost curled up stacked sheet. For this reason, when the sheet cassette is pulled out, it is necessary to increase the lowering speed of the sheet stacking plate but according to the conventional configuration, the lowering speed of the sheet stacking plate can be increased only when the number of sheets stacked on the sheet stacking plate is small, and the above-described problem cannot be solved when a large amount of sheets are stacked.

That is, according to the conventional configuration using the chipped-tooth gear, the lowering speed of the sheet stacking portion cannot be changed midstream depending upon a position (amount of sheets) of the sheet stacking portion when the cassette is pulled out. It is not possible to increase the speed immediately after the sheet stacking portion is lowered when the cassette is pulled out irrespective of the amount of sheets. If a plurality of dampers or chipped-tooth gears are provided, the above-described problem can be solved, but this increases costs and the problem can be solved only in stages.

The present invention has been accomplished in view of the circumstances, and provides a sheet feeding apparatus and an image forming apparatus capable of increasing a speed when a sheet stacking portion is lowered until the sheet stacking portion is lowered by a predetermined amount irrespective of an amount of stacked sheets.

SUMMARY OF THE INVENTION

The present invention provides a sheet feeding apparatus comprising, a sheet accommodating portion which can be brought into and out from an apparatus body, a sheet stacking portion, provided on the accommodating portion, on which is stacked sheets, a lift mechanism which pushes up the sheet stacking portion to a range where uppermost one of the sheets stacked on the sheet stacking portion can be fed, a driving portion provided in the apparatus body, and a damper portion provided on the sheet accommodating portion, wherein the lift mechanism can be engaged with and disengaged from the driving portion, and if the engagement between the lift mechanism and the driving portion is released, the lift mechanism lowers the sheet stacking portion, the damper portion is engaged with the lift mechanism, and if the engagement between the lift mechanism and the driving portion is released, the damper portion exerts damper effect on the lift mechanism to reduce a lowering speed of the sheet stacking portion, and wherein the damper portion does not exert the damper effect on the lift mechanism until the sheet stacking portion is lowered by a predetermined amount after the engagement between the lift mechanism and the driving portion is released.

According to the invention, a damper effect is not exerted on the sheet stacking portion until the sheet stacking portion is lowered by a predetermined amount and therefore, it is possible to increase the speed when the sheet stacking portion is lowered until the sheet stacking portion is lowered by the predetermined amount irrespective of an amount of stacked sheets.

Further features of the present invention will become apparent from the following description of exemplary embodiments with reference to the attached drawings.

DESCRIPTION OF THE EMBODIMENTS

Figure 1:
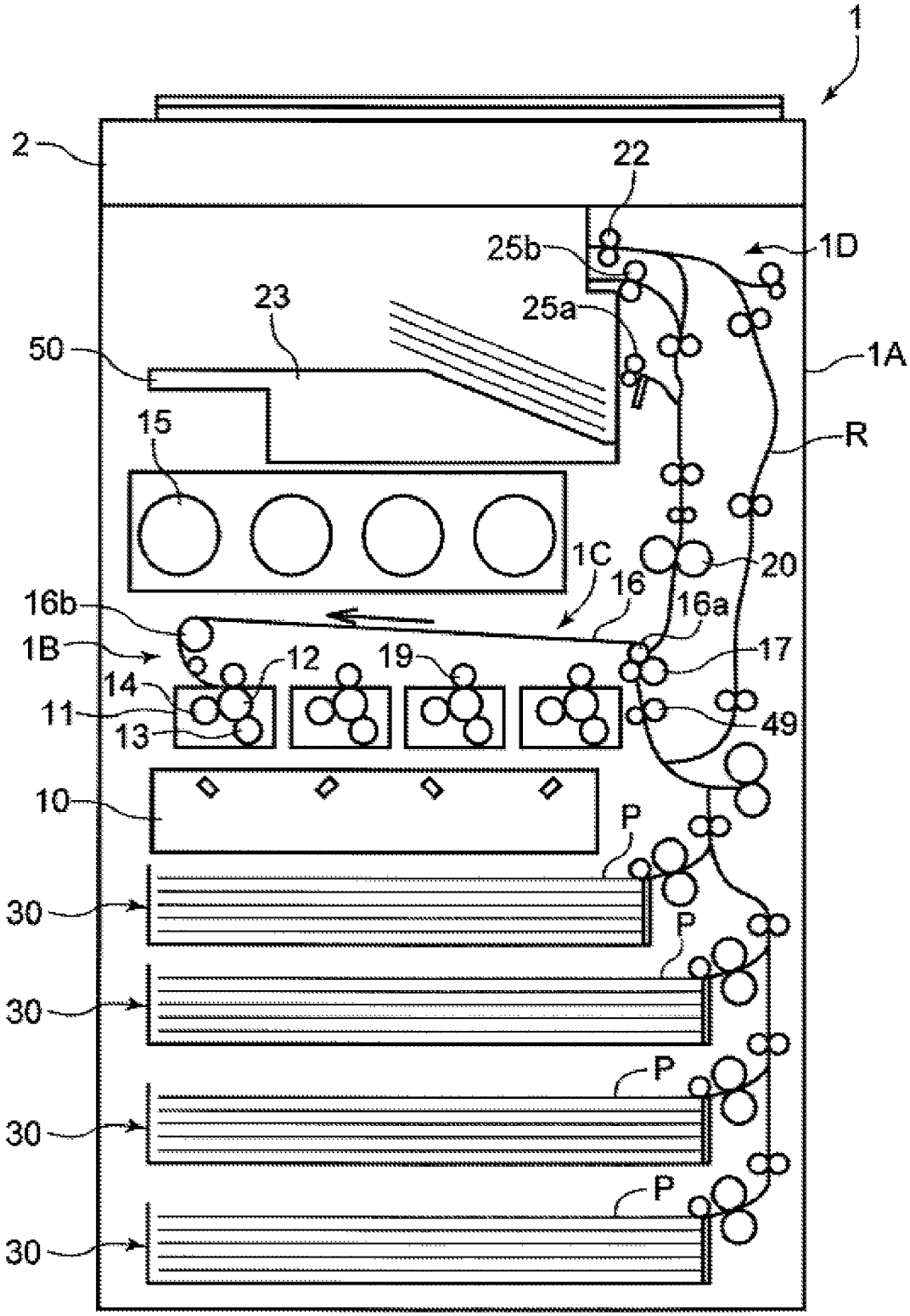
FIG. 1 is a diagram illustrating a general configuration of a full-color laser beam printer which is one example of an image forming apparatus according to an embodiment of the present invention.

Embodiments of the present invention will be described in detail with reference to the drawings. FIG. 1 is a diagram illustrating a general configuration of a full-color laser beam printer which is one example of an image forming apparatus according to the embodiment of the invention.

In FIG. 1, a full-color laser beam printer 1 (printer, hereinafter) includes a printer body 1A which is an image forming apparatus body, an image forming portion 1B which forms an image on a sheet, and a fixing portion 20. An image reading apparatus 2 is an upper portion apparatus disposed substantially horizontally above the printer body 1A, and a sheet discharge space S into which a sheet is discharged is formed between the image reading apparatus 2 and the printer body 1A. The full-color laser beam printer includes a sheet feeding apparatus 30 provided in a lower portion of the printer body 1A, and a toner cartridge 15.

The image forming portion 1B is a drum full-color image forming portion, and includes a laser scanner 10, and four process cartridges 11 which form toner images of four colors, i.e., yellow (Y), magenta (M), cyan (C) and black (K). Each of the process cartridges 11 includes a photosensitive drum 12, a charging device 13 which is a charging portion, a development device 14 which is a development unit, and a cleaner (not illustrated) which is a cleaning unit. The image forming portion 1B includes an intermediate transfer unit 1C disposed above the process cartridges 11.

The intermediate transfer unit 1C includes an intermediate transfer belt 16 which is wound around a driving roller 16*a* and a tension roller 16*b* and which rotates in the direction of arrow. The intermediate transfer unit 1C includes primary transfer rollers 19 which are provided inside of the intermediate transfer belt 16 and which abut against the intermediate transfer belt 16 at locations opposed to the photosensitive drums 12.

Positive transfer bias is applied to the intermediate transfer belt 16 by the primary transfer rollers 19, so that negative toner images of the respective colors on the photosensitive drums are sequentially transferred onto the intermediate transfer belt 16 in a multilayer manner. A secondary transfer roller 17 constituting a secondary transfer portion is provided at a location opposed to the driving roller 16*a* of the intermediate transfer unit 1C, and the secondary transfer roller 17 transfers the color image formed on the intermediate transfer belt onto sheets P.

A fixing portion 20 is disposed on an upper portion of the secondary transfer roller 17, and a pair of first discharge rollers 25*a*, a pair of second discharge rollers 25*b* and a two-sided reversing portion 1D which is a reverse discharge portion are disposed at upper and left portions of the fixing portion 20. The two-sided reversing portion 1D includes a pair of reverse rollers 22 which are sheet reverse conveying rollers capable of normally and reversely rotating, and a re-conveying passage R for conveying again, to the image forming portion 1B, a sheet having an image formed on its one of surfaces.

Next, an image forming operation of the printer 1 having the above-described configuration will be described. The image reading apparatus 2 reads image information of an original, this image information is subjected to image processing and then, the image information is converted into an electric signal and the electric signal is transmitted to the laser scanner 10 of the image forming portion 1B. Image information is input to the image forming portion 1B from an external device such as a personal computer in some cases. The image forming portion 1B scans surfaces of the photosensitive drums 12 of the process cartridges 11 by laser light which is emitted from the laser scanner 10 and which corresponds to image information of color components of yellow, magenta, cyan, and black. With this operation, a surface of each of the photosensitive drums 12 uniformly bears predetermined polarity and potential by the charging device 13, and the surface is sequentially exposed, and electrostatic latent images of yellow, magenta, cyan, and black are sequentially formed on the photosensitive drums of the process cartridges 11.

Thereafter, the electrostatic latent images are developed and visualized by each toner of yellow, magenta, cyan, and black, and the toner images on the photosensitive drums are sequentially transferred onto the intermediate transfer belt 16 in the multilayer manner by primary transfer bias applied to the primary transfer rollers 19. With this operation, the toner image is formed on the intermediate transfer belt 16.

Simultaneously with this toner image forming operation, sheets P are sent out from the sheet feeding apparatus 30 and then, the sheets P are conveyed to a pair of registration rollers 49. Skew feeding of the sheets P is corrected by the pair of registration rollers 49, and the sheets P are conveyed to a secondary transfer portion including the driving roller 16*a* and the secondary transfer roller 17 such that a position of the sheets P and the toner images on the intermediate transfer belt match with each other by the secondary transfer portion. Thereafter, the toner images are collectively transferred onto the sheets P by secondary transfer bias applied to the secondary transfer roller 17 by the secondary transfer portion.

Next, the sheets P onto which the toner image is transferred is conveyed to the fixing portion 20, the sheets P are heated and pressurized in the fixing portion 20, toner of respective colors is melted and mixed, and fixed as a color image on the sheets P. Thereafter, the sheets P to which the image is fixed are discharged to a stacking portion 23 by the pair of first discharge rollers 25*a*. When images are to be formed on both surfaces of the sheet, after the sheet having an image on its one surface passes through the fixing portion 20, a pair of reverse rollers 22 reversely rotates, the sheets P are conveyed to the re-conveying passage R by reverse rotation and then, the sheets P are conveyed to the pair of registration rollers 49 again. An image is formed on the back surface, and stacked on the stacking portion 23 by the pair of first discharge rollers 25*a*.

Figure 2:
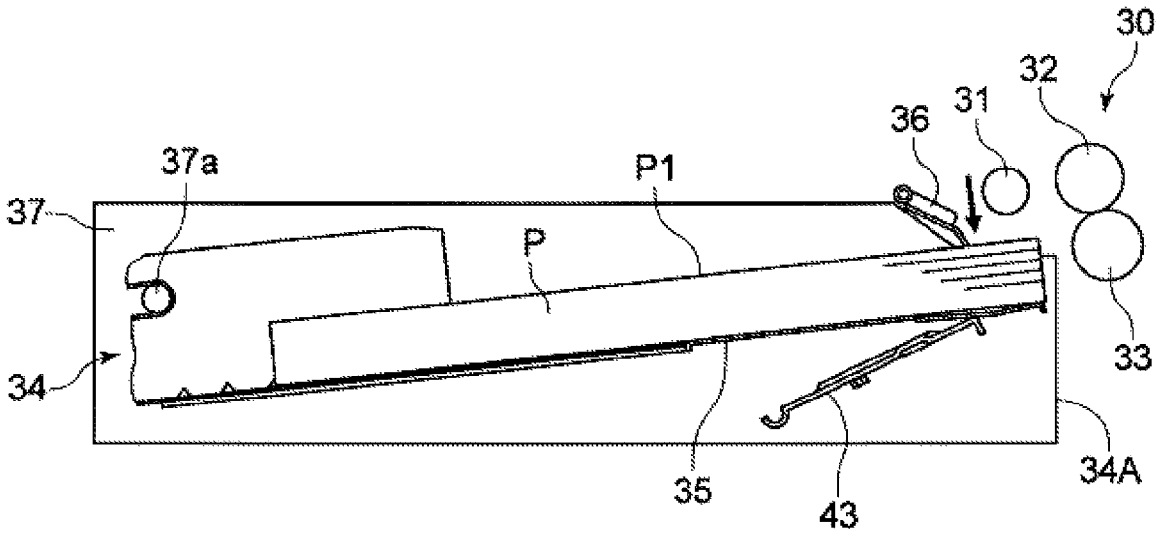
FIG. 2 is a diagram illustrating a configuration of a sheet feeding apparatus provided in the full-color laser beam printer.

FIG. 2 is a diagram illustrating a configuration of the sheet feeding apparatus 30. The sheet feeding apparatus 30 includes a sheet stacking plate (sheet stacking portion) 35 capable of being lifted, and sheets P are stacked on the sheet stacking plate 35, and also includes a sheet cassette 34 in which sheets P are accommodated, and a feeding roller 31 for picking up uppermost one of sheets P stacked on the sheet stacking plate 35. This sheet cassette 34 can be pulled out from a front surface (operating side) of the printer 1, and this pulling-out direction is perpendicular to a feeding direction of sheets from the sheet cassette 34. The sheet feeding apparatus 30 includes a pair of separating conveying rollers 32 and including a conveying roller 32 and a separating roller 33, and a sheet presence/absence sensor 36 which detects whether there is a sheet on the sheet stacking plate 35.

The pair of separating conveying rollers 32 and 33 separates an uppermost sheet P1 of sheets sent out by the feeding roller 31, and conveys the sheet P1 to the pair of registration rollers 49. As the sheet feeding operation proceeds, the sheets P on the sheet stacking plate 35 are reduced, and according to the reduction of sheets, control is performed to lift the sheet stacking plate 35 so that the sheet surface comes to such a height that the sheet can be fed. If sheets on the sheet stacking plate 35 run out and the sheet presence/absence sensor 36 detects this, a controlling portion (not illustrated) stops the sheet feeding operation, a message that sheets should be supplied is displayed on a panel. If a user is informed that sheets run out, the user pulls out the sheet cassette 34 and supplies sheets.

Figure 3A:
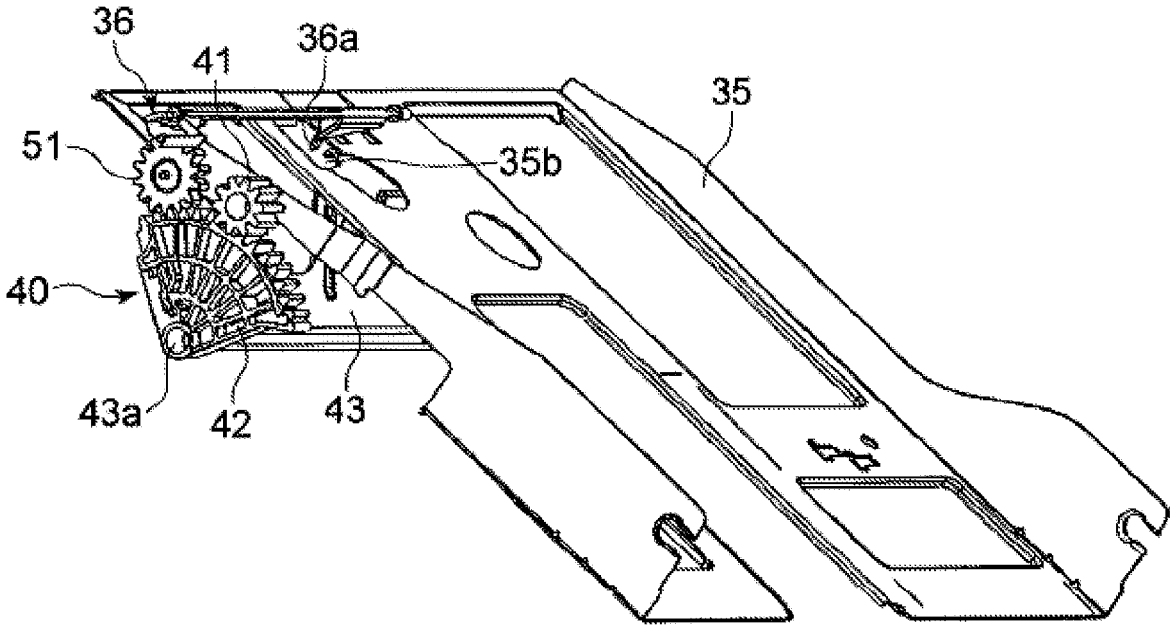
FIGS. 3A and 3B are diagrams for explaining a lift mechanism provided in the sheet feeding apparatus.
Figure 3B:
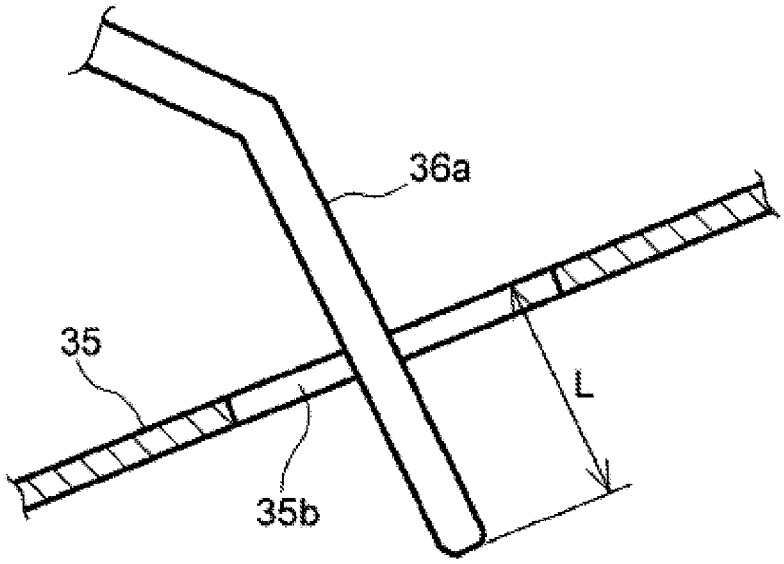

As illustrated in FIGS. 3A and 3B, the sheet cassette 34 which is a sheet accommodating portion includes a lift mechanism 40 which pushes up the sheet stacking plate 35 when sheets are fed, and moves the sheet stacking plate 35 to a range where the uppermost sheet of the stacked sheets can be fed. The lift mechanism 40 can be engaged with and disengaged from a driving input gear 41 which is a driving portion provided on the side of the printer body, and the lift mechanism 40 includes a sector gear 42 which is driven such that the sector gear 42 is engaged with the driving input gear 41 to push up the sheet stacking plate 35 to a range where a sheet can be fed. The sector gear 42 is integrally provided with a lifter plate 43 for pushing up the sheet stacking plate 35.

If the sheet cassette 34 is attached to the printer body, the driving input gear 41 and the sector gear 42 are engaged (meshed) with each other, and if the driving input gear 41 rotates and the sector gear rotates, the lifter plate 43 upwardly turns integrally with the sector gear 42. With this, the sheet stacking plate 35 moves to the range where a sheet can be fed. If the engagement between the sector gear 42 and the driving input gear 41 is released when the sheet cassette 34 is pulled out from the printer body. Therefore, the lift mechanism 40 loses a force for supporting the sheet stacking plate 35, the sheet stacking plate 35 is lowered.

In FIG. 3A, if all of sheets in the sheet cassette are fed and the apparatus runs out of paper, a sheet presence/absence sensor flag 36*a* enters an opening 35*b* formed in the sheet stacking plate 35. If the sheet presence/absence sensor flag 36*a* enters the opening 35*b* of the sheet stacking plate 35 in this manner, the sheet presence/absence sensor 36 outputs a paper-run out signal to the controlling portion (not illustrated). As illustrated in FIG. 3B, if a tip end of the sheet presence/absence sensor flag 36*a* enters from the opening 35*b* of the sheet stacking plate 35 by a predetermined length L, the paper-run out signal is output. A damper gear 51 constitutes a damper portion which is engaged with the sector gear 42 of the lift mechanism 40, and which exerts damper effect on the sheet stacking plate 35 that is disengaged with the driving input gear 41 of the lift mechanism 40 and that lowers.

Figure 4A:
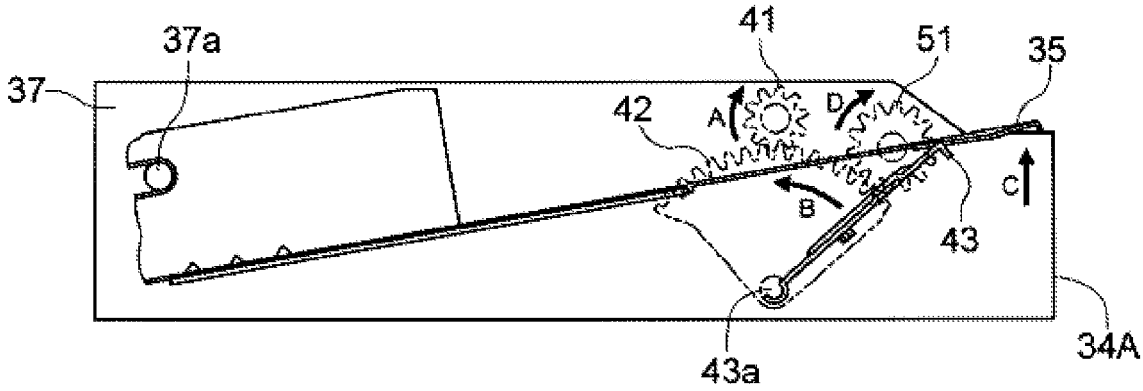
FIGS. 4A and 4B are diagrams for explaining an operation of the lift mechanism.

Next, an operation of the lift mechanism 40 having the above-described configuration will be described with reference to FIGS. 4A and 4B. If the sheet cassette 34 is attached to the printer body, the driving input gear 41 and the sector gear 42 mesh with each other, and if the driving input gear 41 rotates in the direction of arrow A thereafter as illustrated in FIG. 4A, the sector gear 42 rotates around a shaft 43*a* in the direction of arrow B. With this motion, the lifter plate 43 upwardly turns in the direction of arrow C around the shaft 43*a* as a fulcrum integrally with the sector gear 42, and the sheet stacking plate 35 turns around a shaft 37*a* provided on a side surface of a cassette body 34A. If the sector gear 42 rotates in this manner, a driving force is transmitted from the sector gear 42 to the damper gear 51, and the damper gear 51 rotates in the direction of arrow D.

Thereafter, sheets are sequentially sent out by the feeding roller 31, and if the amount of sheets on the sheet stacking plate 35 is reduced, the driving input gear 41 rotates, and the lifter plate 43 is upwardly turned through the sector gear 42. If all of sheets are fed and sheets on the sheet stacking plate run out as illustrated in FIG. 4A, the sheet presence/absence sensor flag 36*a* enters the opening 35*b* of the sheet stacking plate 35 as illustrated in FIGS. 3A and 3B, and the sheet presence/absence sensor 36 outputs the paper-run out signal to the controlling portion. Based on this paper-run out signal, the controlling portion informs a user that sheets on the sheet stacking plate 35 run out.

With this, the user pulls out the sheet cassette 34 from the printer body 1A and supplies sheets. When the sheet cassette 34 is pulled out from the printer body 1A, the meshed state with the driving input gear 41 which is a driving source is released, and then, the sector gear 42 loses the ability to support the sheet stacking plate 35. Therefore, the sheet stacking plate 35 is lowered by its own weight as illustrated in FIG. 4B.

As illustrated in FIGS. 5A to 5D, a gear portion 54 integrally provided with a shaft 54*a*, and a damper resistance member 52 integrally provided with a shaft 52*a* are constructed in a damper gear 51, and the damper resistance member 52 is slidably supported by the gear portion 54 while forming a space 58 between the damper resistance member 52 and the gear portion 54. The damper resistance member 52 can slide with respect to the gear portion 54 and the damper resistance member 52 is coaxial with the gear portion 54. Frictional resistance member such as oil and friction powder (magnetic resistance in some cases) is charged into the space 58 between the damper resistance member 52 and the gear portion 54. The frictional resistance member is charged into the space 58, and a frictional force is generated on the damper resistance member 52 which is a sliding member with respect to the gear portion 54.

The shaft 54*a* of the gear portion 54 of the damper gear 51 is rotatably supported by a support member (not illustrated) provided on the cassette body. The shaft 52*a* which is a rotation shaft of the damper resistance member 52 is rotatably supported by a later-described shaft hole 38 illustrated in FIGS. 6A and 6B formed on an outer wall surface of a side plate 37 of the cassette body 34A. A rotation range of the shaft 52*a* of the damper resistance member 52 is limited to a predetermined angle, and by limiting the rotation range of the shaft 52*a* in this manner, rotation resistance (damper effect) when the gear portion 54 rotates is exerted by frictional resistance in the damper gear.

Figure 6A:
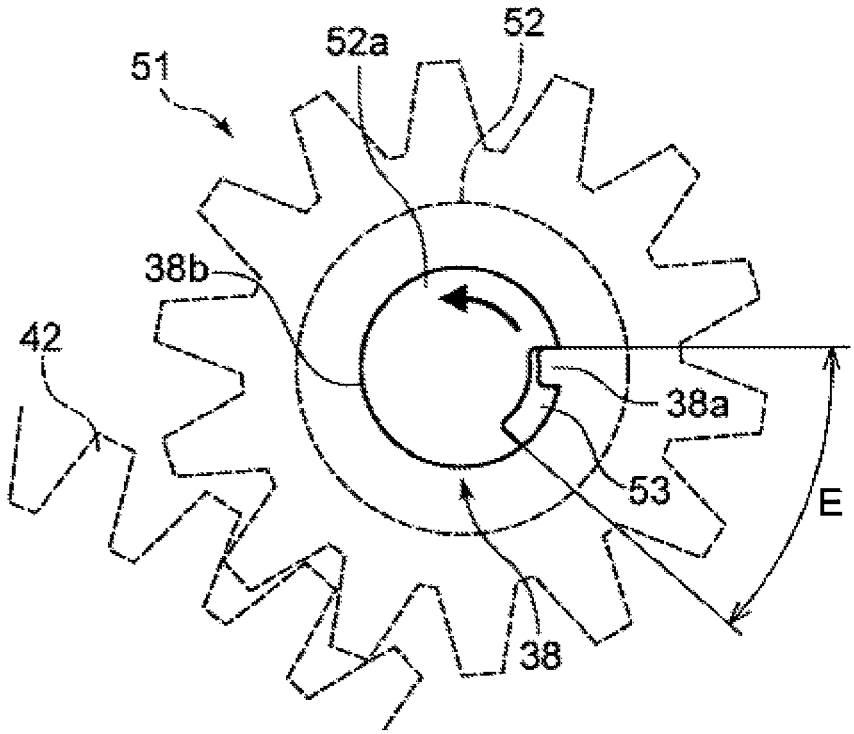
FIGS. 6A and 6B are diagrams for explaining an operation of a damper resistance member constituting the damper gear.

In this embodiment, as illustrated in FIG. 6A, an arc space 53 is provided in the shaft 52*a* of the damper resistance member 52. The space 53 is formed by cutting an outer peripheral surface of the shaft 52*a* by a predetermined angle E°. The shaft 52*a* of the damper resistance member 52 is supported by the shaft hole formed in the outer wall surface of the side plate 37 of the cassette body 34A. A sliding surface 38*b* which comes into contact with the outer peripheral surface of the shaft 52*a* of the damper resistance member 52, and a projection 38*a* which enters the space 53 of the shaft 52*a* are formed on the shaft hole 38.

According to this configuration, if the damper gear 51 is rotated, the damper resistance member 52 integrally rotates with the gear portion 54 within a range of the space 53, i.e., a range of the predetermined angle E°, and if the damper resistance member 52 exceeds the predetermined angle E°, the rotation is limited by the projection 38*a*. By providing the space 53 in the shaft 52*a* in this manner, the damper gear 51 can rotate in a state having no damper effect in the rotation direction by rotation of the predetermined angle E°. In this embodiment, the space 53 and the projection 38*a* constitute a rotation-restricting portion. If the sheet stacking plate 35 is lowered by a predetermined amount, the rotation-restricting portion restricts rotation of the damper resistance member 52 such that the gear portion 54 slides with respect to the damper resistance member 52.

This predetermined angle E° is set in the following manner. As illustrated in FIG. 3B, if a tip end of the sheet presence/absence sensor flag 36*a* enters from the opening 35*b* of the sheet stacking plate 35, the paper-run out signal is output and a user is informed of this fact. The user pulled out the sheet cassette 34 but at that time, if the tip end of the sheet presence/absence sensor flag 36*a* enters the opening 35*b*, there is an adverse possibility that the sheet presence/absence sensor flag 36*a* is damaged.

Hence, when the sheet cassette 34 is pulled out, it is necessary to lower the sheet stacking plate 35 by an amount more than an entering amount (size L) of the sheet presence/absence sensor flag 36*a* into the opening 35*b*. That is, the predetermined angle E° is set to such a value that when the sheet cassette 34 is pulled out, the sheet stacking plate 35 is lowered fast to a position where the sheet presence/absence sensor flag 36*a* is not caught at an edge of the opening 35*b*.

Figure 6B:
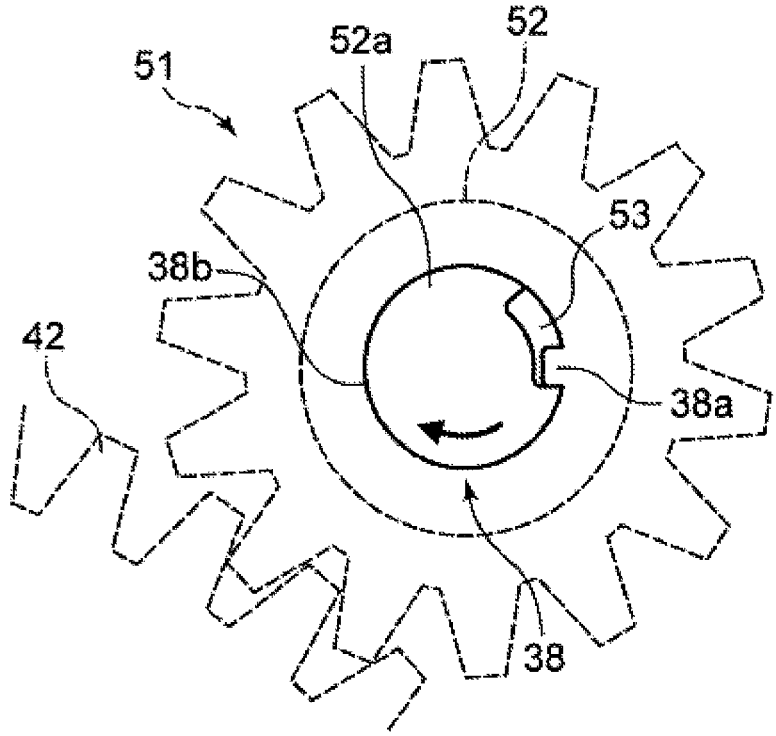

FIG. 6A illustrates a state of the damper resistance member 52 when sheets run out as illustrated in FIG. 4A. FIG. 6B illustrates a state of the damper resistance member 52 immediately after the sheets P run out and the sheet cassette 34 is pulled out from the printer body 1A as illustrated in FIG. 4B.

Next, an operation of the damper gear 51 having the above-described configuration when the sheet cassette 34 is attached to the printer body 1A will be described. If the sheet cassette 34 is attached to the printer body 1A, the driving input gear 41 and the sector gear 42 mesh with each other, a driving force is transmitted from the driving input gear 41 to the sector gear 42, and the gear portion 54 of the damper gear 51 rotates in the direction of arrow D illustrated in FIG. 4A. At that time, the damper resistance member 52 rotates integrally with the gear portion 54 by the predetermined angle E°, but when the damper resistance member 52 rotates integrally with the gear portion 54 by the predetermined angle, the damper gear 51 rotates in a state where the damper gear 51 does not exert the damper effect (idling rotation, hereinafter).

At an initial stage of rotation of the driving input gear 41 and the damper gear 51, the projection 38*a* and the space 53 have a positional relation as illustrated in FIG. 6B, i.e., a positional relation in which the projection 38*a* is in contact with a lower end of the space 53. However, if the driving input gear 41 further rotates in the direction D, the damper gear 51 (damper resistance member 52) rotates in the direction of arrow and as illustrated in FIG. 6A, the projection 38*a* abuts against an upper end of the space 53 of the damper resistance member 52, and rotation of the damper resistance member 52 is restricted. Therefore, if the driving input gear 41 rotates thereafter, the rotation of the damper resistance member 52 is restricted. Therefore, the damper gear 51 lifts the sheet stacking plate 35 while exerting the damper effect.

Next, an operation of the damper gear 51 when the sheet cassette 34 is pulled out from the printer body 1A will be described. If the sheet cassette 34 is pulled out forward of the printer body, a driving connection between the driving input gear 41 and the sector gear 42 is cut off. With this, the sector gear 42 and the lifter plate 43 turn in the direction of arrow F illustrated in FIG. 4B by a weight of the sheet stacking plate 35 of its own, and the sheet stacking plate 35 is lowered in the direction of arrow G.

At the same time, the damper gear 51 which is driving-connected to the sector gear 42 rotates in the direction of arrow H. Here, if the damper gear 51 rotates in this manner, in an initial stage of rotation, the projection 38*a* and the space 53 have a positional relation as illustrated in FIG. 6A, i.e., a positional relation in which the projection 38*a* is in contact with an upper end of the space 53. However, if the driving input gear 41 rotates in the direction H, the damper gear 51 (damper resistance member 52) rotates in the direction of arrow as illustrated in FIG. 6A, the projection 38*a* abuts against the lower end of the space 53, and rotation of the damper resistance member 52 is restricted. With this, if the driving input gear 41 rotates thereafter, the rotation of the damper resistance member 52 is restricted. Therefore, the damper gear 51 lowers the sheet stacking plate 35 while exerting the damper effect.

Figure 4B:
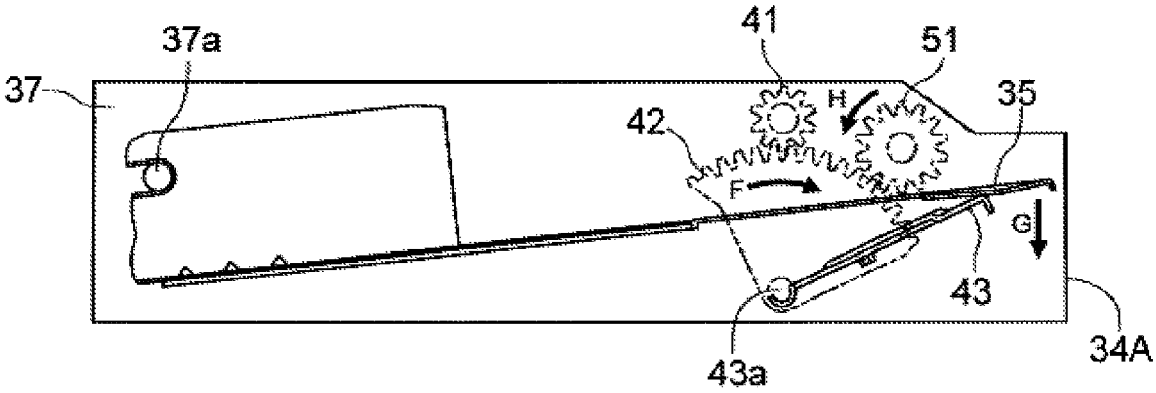
Figure 5A:
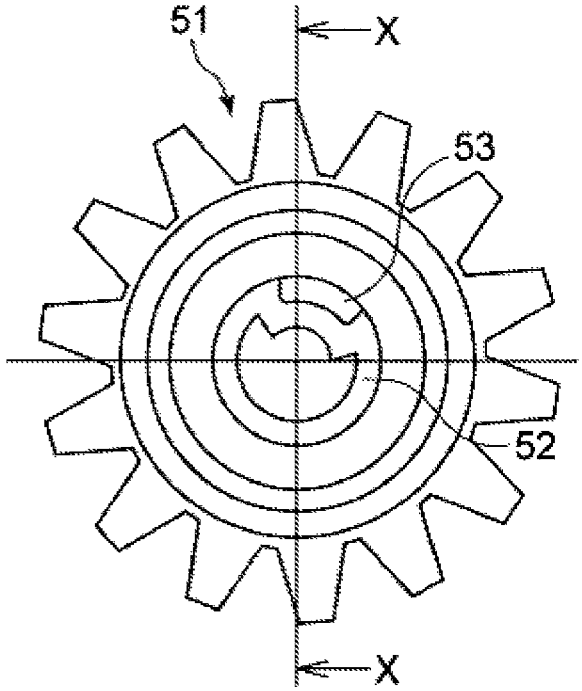
FIGS. 5A to 5D are diagrams for explaining a damper gear provided in the lift mechanism.
Figure 5B:
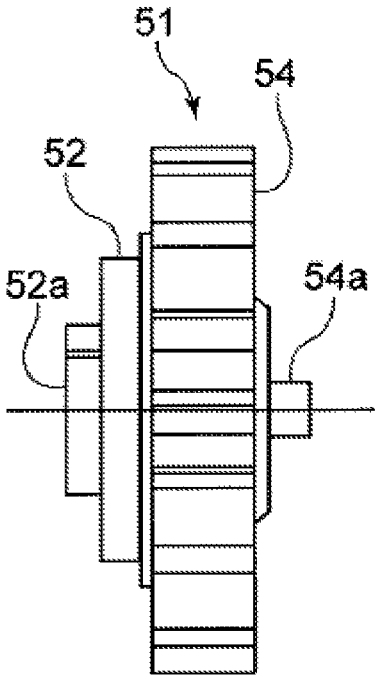
Figure 5C:
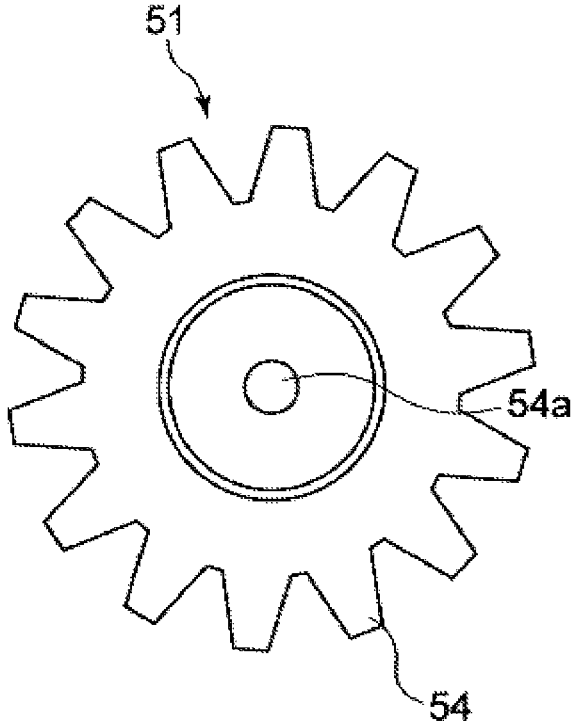
Figure 5D:
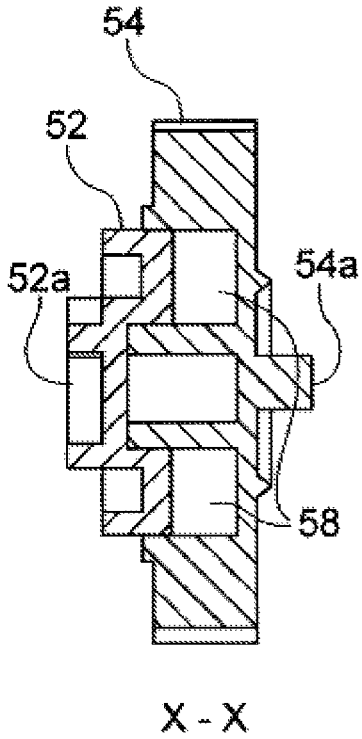

That is, since the space 53 constituting an idling rotation region is provided in the shaft 52*a* of the damper resistance member 52, the sheet stacking plate 35 is lowered to the position illustrated in FIG. 4B by the predetermined angle E° in a state where the damper effect is not exerted by the damper gear 51. Thereafter, the damper resistance member 52 assumes the state illustrated in FIG. 6B, and the damper gear 51 exerts the damper effect.

According to this configuration, when the sheet cassette is pulled out, the idling rotation state in which there is no damper effect which gives resistance to the lowering operation of the sheet stacking plate 35 is established immediately after the driving connection of the driving input gear 41 with respect to the sector gear 42 is released and therefore, the lowering speed of the sheet stacking plate 35 is increased. After the damper resistance member 52 is rotated by the predetermined angle E° and lowered by a predetermined amount, the lowering speed of the sheet stacking plate 35 is reduced by the damper effect.

As described above, in this embodiment, the lowering speed of the sheet stacking plate 35 can be increased immediately after the driving connection of the driving portion (input gear 41) is released, and the lowering speed of the sheet stacking plate 35 can be reduced by the damper effect after the damper resistance member 52 rotates by the predetermined angle E°. With this, the lowering speed of the sheet stacking plate 35 can be increased immediately after the driving connection of the driving portion is released irrespective of the stacking amount of sheets of the sheet stacking plate 35, i.e., irrespective of a lifting position of the sheet stacking plate 35.

As a result, it is possible not only to prevent noise caused when the sheet stacking plate 35 is lowered, but also to prevent the sheet presence/absence sensor and the feeding roller from being damaged. Further, since the chipped-tooth gear is used like the conventional technique, it is possible to delete meshing failure peculiar to the chipped-tooth gear, and to delete impulsive sound caused at the time of meshing. Further, if the chipped-tooth gear is used, it is necessary to strictly manage the size precision of shape because the shape is varied due to a molding machine, and the molding precision is required, so that if the chipped-tooth gear is not used, cost can be reduced.

In the above description, the space is provided in the damper resistance member 52 of the damper gear 51, a projection 38*a* is provided on the shaft hole 38 formed in the side wall surface of the cassette body 34A, and the projection 38*a* is provided on the shaft hole 38, but the present invention is not limited to these configurations. For example, a space may be provided on one of the shaft 52*a* of the damper resistance member 52 and the shaft hole 38 of the cassette body 34A, and the projection 38*a* which moves in the space and which rotates the damper resistance member 52 integrally with the gear portion 54 by the predetermined angle may be provided on the other one. That is, the space may be formed in the shaft hole formed in the outer wall surface of the side plate of the cassette body, and the projection may be formed on the damper resistance member which is axially supported by the shaft hole.

Figure 7A:
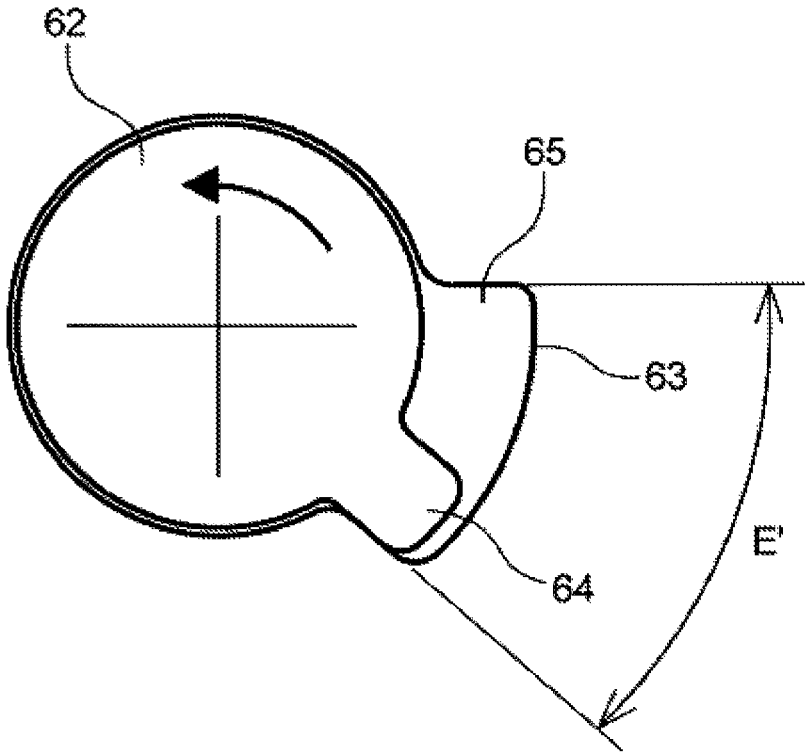
FIGS. 7A and 7B are diagrams for explaining a configuration of a damper gear provided in a lift mechanism of a sheet feeding apparatus according to a second embodiment of the invention.
Figure 7B:
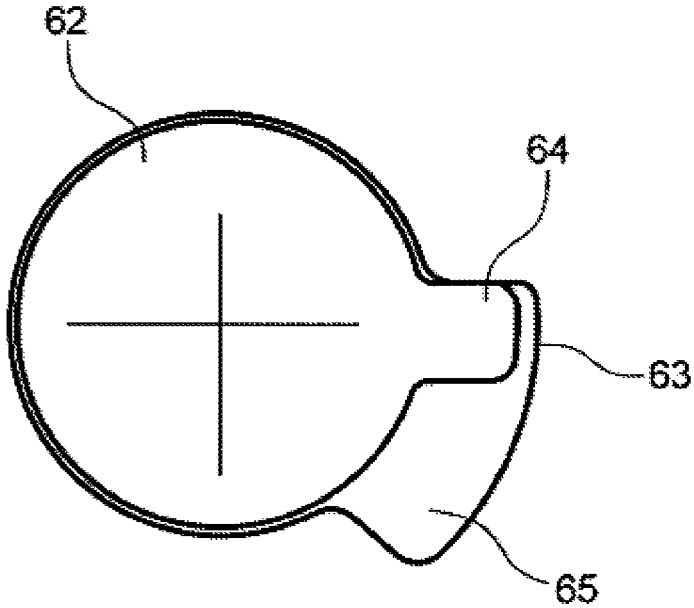
Figure 8:
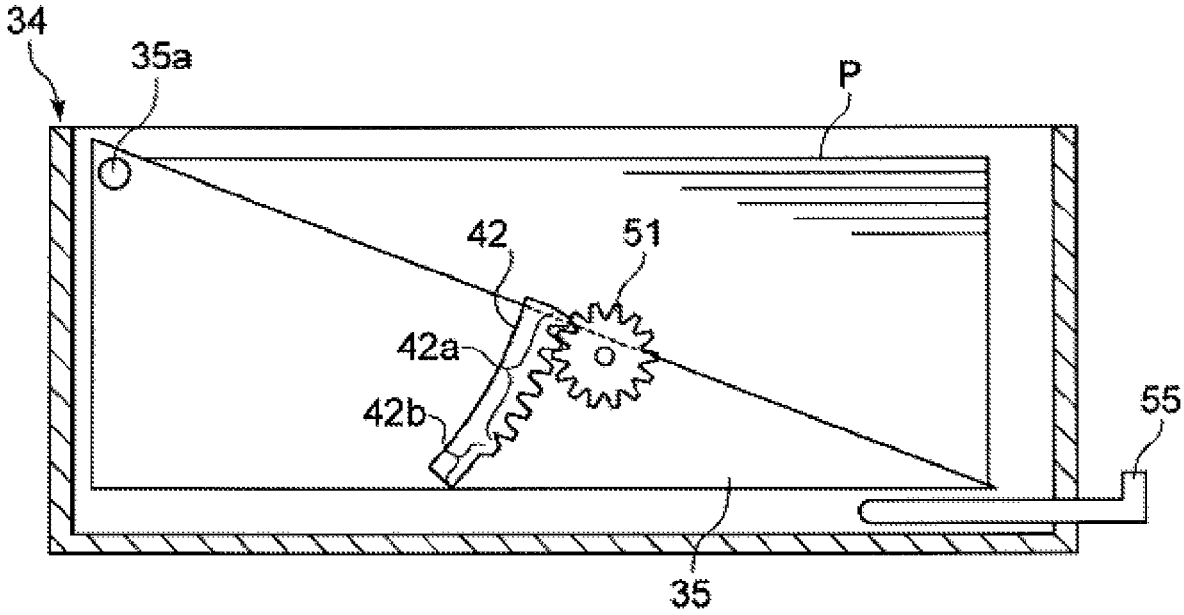
FIG. 8 PRIOR ART
FIG. 8 is a diagram illustrating a configuration of a sheet cassette having the conventional damper mechanism.

Next, a second embodiment of the invention having such configurations will be described. FIGS. 7A and 7B are diagrams for explaining a configuration of a damper gear provided in a lift mechanism of a sheet feeding apparatus according to the second embodiment. In FIGS. 7A and 7B, a projection 64 is formed on a peripheral surface of a shaft 62 of a damper resistance member of the damper gear. A shaft hole 63 is formed on an outer wall surface of a side plate of a cassette body, and a space 65 into which the projection 64 of the shaft 62 is formed in the shaft hole 63.

According to such configuration, like the above-described first embodiment, a driving input gear rotates immediately after the sheet cassette 34 is inserted into the printer body, and when the sheet stacking plate is to be lifted, the projection 64 of the shaft 62 move to a position (A) from a position (B) in FIGS. 7A and 7B. Thereafter, if the driving input gear keeps rotating, the shaft 62 stays at the position (A) and the sheet stacking plate is lifted.

When the sheet cassette is pulled out, if the damper gear (damper resistance member) rotates in the direction of arrow illustrated in FIG. 7A immediately after the driving connection of the driving portion is released, the shaft 62 of the damper resistance member moves from the position (A) to the position (B) in FIG. 7 in the space 65 of the shaft hole 63. At that time, since a damper gear 61 idles without damper effect by a predetermined angle E'°, the lowering speed of the sheet stacking plate is faster as compared with a case where there is the damper effect. According to this, the same effect as that of the first embodiment can be obtained.

In the second embodiment, since the projection 64 which moves in the space is provided on the shaft 62 of the damper resistance member, the moving angle E'° of the space can be changed depending on the shape of the shaft hole 63. According to this configuration, in device models having different using conditions, diversion usability of the damper gear is enhanced. For example, in order to change a lowering amount of the sheet stacking plate in a state where there is no damper effect, the damper gear is changed in the first embodiment, but in the second embodiment, since the shape of the shaft hole 63 is changed. Since cassettes are different in every device model in many cases, it is easy to change a shape of a hole when a new device is produced. In this case, it is possible to enhance the diversion usability even if a damper gear is not produced for every different device.

In the above description, a tandem type vertical sheet conveying type color laser beam printer is illustrated, but the present invention is not limited to this. The invention can also be applied to a horizontal sheet conveying type image forming apparatus and a monochrome laser beam printer. Further, a cassette type sheet stacking apparatus was used, but even if the invention is utilized for a deck type sheet stacking apparatus capable of stacking a large amount of sheets, the same effect can be obtained. The invention is not limited to the sheet stacking plate, and the invention can be utilized when it is necessary to increase a lowering speed of a stacked object immediately after a releasing operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-086464, filed Apr. 2, 2010, which is hereby incorporated by reference herein in its entirety.

What is claimed is:

1. A sheet feeding apparatus comprising;

a sheet accommodating portion which can be drawn from an apparatus body;

a sheet stacking portion, provided on the sheet accommodating portion, on which is stacked sheets;

a lift mechanism which pushes up the sheet stacking portion to a range where an uppermost one of the sheets stacked on the sheet stacking portion can be fed by a sheet feeding portion;

a driving portion provided in the apparatus body, which drives the lift mechanism, and an engagement between the lift mechanism and the driving portion is releasable to lower the sheet stacking portion in connection with a drawing of the sheet accommodating portion; and a damper gear, provided on the sheet accommodating portion, which is engaged with the lift mechanism, and as the engagement of the lift mechanism and the driving portion is released, the damper gear exerts a damper effect on the lift mechanism to reduce a lowering speed of the sheet stacking portion, wherein the damper gear includes:

a gear portion which is engaged with the lift mechanism and rotates;

a sliding member which can slide with respect to the gear portion;

a frictional resistance member which is provided between the gear portion and the sliding member, and which generates resistance by a frictional force between the sliding member and the gear portion; and an idling region where the gear portion rotates without exerting the damper effect to the lift mechanism, and when the engagement between the lift mechanism and the driving portion is released, the sheet stacking portion is lowered by a constant amount at the idling region, and after the sheet stacking portion is lowered by the constant amount at the idling region, the gear portion slides with respect to the sliding member against the frictional force of the frictional resistance member to exert the damper effect on the lift mechanism.

2. The sheet feeding apparatus according to claim 1, further comprising a rotation-restricting portion that restricts rotation of the sliding member such that the gear portion slides with respect to the sliding member against the frictional force of the frictional resistance member, wherein the rotation-restricting portion includes:

a space which is formed in one of a rotation shaft of the sliding member and a shaft hole, provided on the sheet accommodating portion, in which the rotation shaft of the sliding member is axially supported, the sliding member and the gear portion integrally rotating in the space by a predetermined angle; and a projection which is formed on the other one of the rotation shaft of the sliding member and the shaft hole of the sheet accommodating portion, which moves in the space, and the projection rotates the sliding member integrally with the gear portion by the predetermined angle.

3. The sheet feeding apparatus according to claim 1, further comprising a sheet presence/absence sensor which detects a sheet presence or absence on the sheet stacking portion based on a position of a sensor flag, the sensor flag can be inserted into an opening formed in the sheet stacking plate in a case of an absence of the sheets on the sheet stacking portion, wherein an amount of the idling region is set to such a value that when the sheet accommodating portion is pulled out, the sheet stacking portion is lowered fast to a position where the sensor flag is not caught at an edge of the opening.

4. An image forming apparatus has a sheet feeding apparatus and an image forming portion which forms an image on a sheet fed from the sheet feeding apparatus, the image forming apparatus comprising:

a sheet accommodating portion which can be drawn from an apparatus body;

a sheet stacking portion, provided on the sheet accommodating portion, on which is stacked sheets;

a lift mechanism which pushes up the sheet stacking portion to a range where an uppermost one of the sheets stacked on the sheet stacking portion can be fed by a sheet feeding portion;

a driving portion provided in the apparatus body, which drives the lift mechanism, and an engagement between the lift mechanism and the driving portion is releasable to lower the sheet stacking portion in connection with a drawing of the sheet accommodating portion; and a damper gear provided on the sheet accommodating portion, which is engaged with the lift mechanism, and as the engagement of the lift mechanism and the driving portion is released, the damper gear exerts a damper effect on the lift mechanism to reduce a lowering speed of the sheet stacking portion, wherein the damper gear includes:

a gear portion which is engaged with the lift mechanism and rotates;

a sliding member which can slide with respect to the gear portion;

a frictional resistance member which is provided between the engage portion and the sliding member, and which generates resistance by a frictional force between the sliding member and the gear portion; and an idling region where the gear portion rotates without exerting the damper effect to the lift mechanism, and when the engagement between the lift mechanism and the driving portion is released, the sheet stacking portion is lowered by a constant amount at the idling region, and after the sheet stacking portion is lowered by the constant amount at the idling region, the gear portion slides with respect to the sliding member against the frictional force of the frictional resistance member to exert the damper effect on the lift mechanism.

5. The image forming apparatus according to claim 4, further comprising a rotation-restricting portion that restricts rotation of the sliding member such that the gear portion slides with respect to the sliding member against the frictional force of the frictional resistance member, wherein the rotation-restricting portion includes:

a space which is formed in one of a rotation shaft of the sliding member and a shaft hole, provided on the sheet accommodating portion, in which the rotation shaft of the sliding member is axially supported, the sliding member and the gear portion integrally rotating in the space by a predetermined angle; and a projection which is formed on the other one of the rotation shaft of the sliding member and the shaft hole of the sheet accommodating portion, which moves in the space, and the projection rotates the sliding member integrally with the gear portion by the predetermined angle.

6. The image forming apparatus according to claim 4 further comprising a sheet presence/absence sensor which detects a sheet presence or absence on the sheet stacking portion based on a position of a sensor flag, the sensor flag can be inserted into an opening formed in the sheet stacking portion in a case of an absence of the sheets on the sheet stacking portion, wherein an amount of the idling region is set to such a value that when the sheet accommodating portion is pulled out, the sheet stacking portion is lowered fast to a position where the sensor flag is not caught at an edge of the opening.

* * * * *